United States Patent [19]

Norman

[11] 4,051,837

[45] Oct. 4, 1977

[54] ATTACHABLE CAMP OVEN

[76] Inventor: Ambrose Norman, Box 67, Unalakleet, Alaska 99684

[21] Appl. No.: 697,618

[22] Filed: June 18, 1976

[51] Int. Cl.[2] ..... F24C 15/00

[52] U.S. Cl. ..... 126/275 R; 126/9 R

[58] Field of Search ..... 126/275, 9 R, 9 B, 38

[56] References Cited

U.S. PATENT DOCUMENTS

| | | | |
|---|---|---|---|
| 1,262,209 | 4/1918 | King | 126/275 R |
| 1,461,280 | 7/1923 | McBride | 126/275 R |
| 3,270,740 | 9/1966 | Koos | 126/275 R |
| 3,892,222 | 7/1975 | Darbo | 126/9 R |

*Primary Examiner*—Edward G. Favors

[57] ABSTRACT

This oven consists primarily of a hollow outer casing, which fits onto a camp stove, and receives an inner casing having adjustable rack means therein. The oven includes a frame with door means, and the outer casing has a pair of hinged portions, which are adaptable to fit the camp stove.

3 Claims, 6 Drawing Figures

ATTACHABLE CAMP OVEN

This invention relates to camp stoves, and more particularly to an attachable oven for a camp stove.

It is, therefore, the principal object of this invention to provide an attachable oven for a camp stove, which may be used indoors or out, the outer casing of which is quickly adaptable to the structure of the camp stove.

Another object of this invention is to provide an attachable oven, of the type described, which will have an outer casing with hinged portions for engaging the stove, and the hinged portions are removably received within wooden base supports.

A further object of this invention is to provide an oven, of the type described, which will have a removable inner casing, with adjustable rack means, for supporting whatever is to be baked or cooked.

A still further object of this invention is to provide an oven, of the type described, which may vary in size, so as to be adaptable to various sizes of camp stoves.

Other objects of the invention are to provide an attachable oven for a camp stove, which is simple in design, inexpensive to manufacture, rugged in construction, easy to use and efficient in operation.

These and other objects will be readily evident upon a study of the following specification, and the accompanying drawings, wherein.

Figure 1:
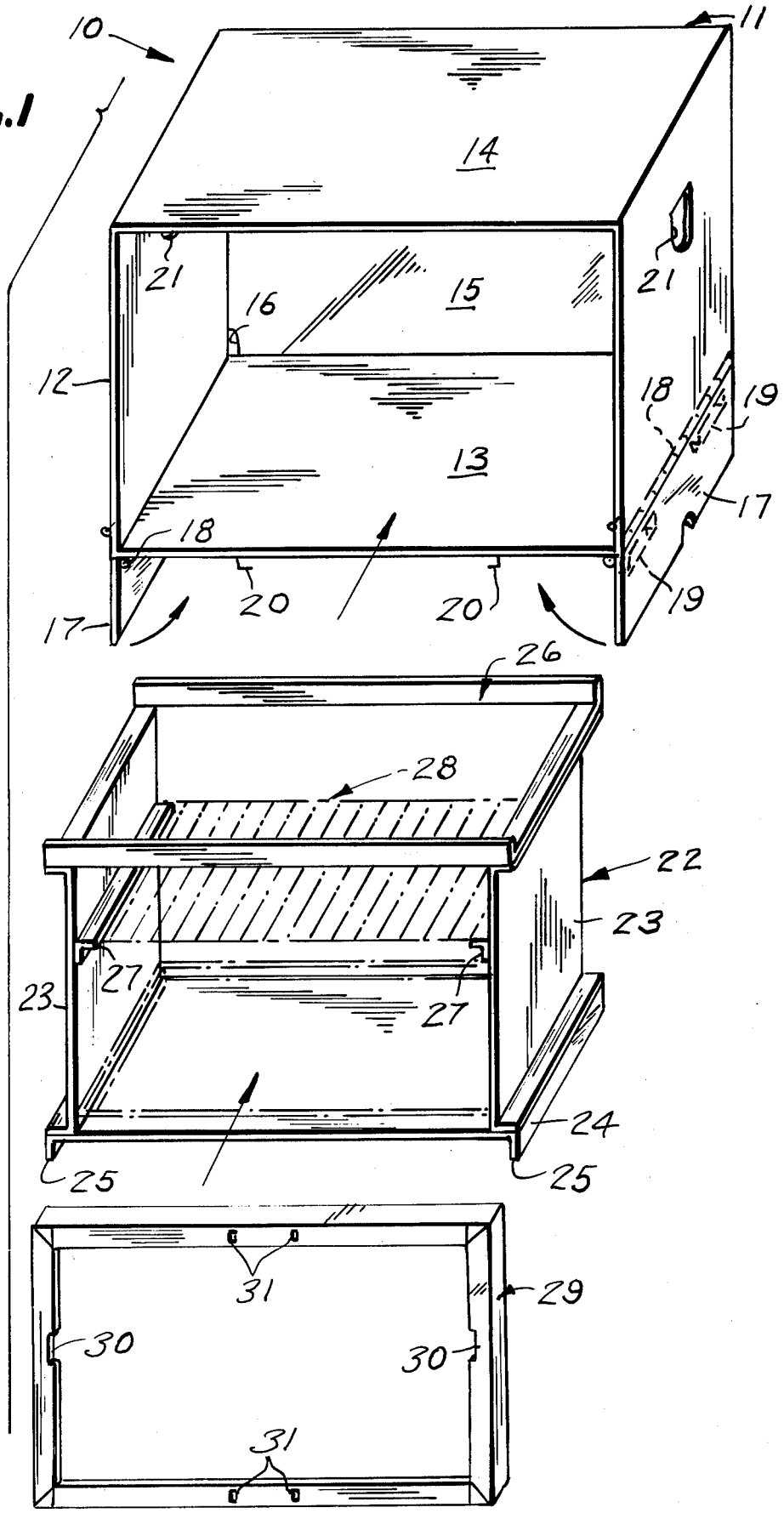
FIG. 1 is a fragmentary and exploded perspective view of the present invention.
Figure 2:
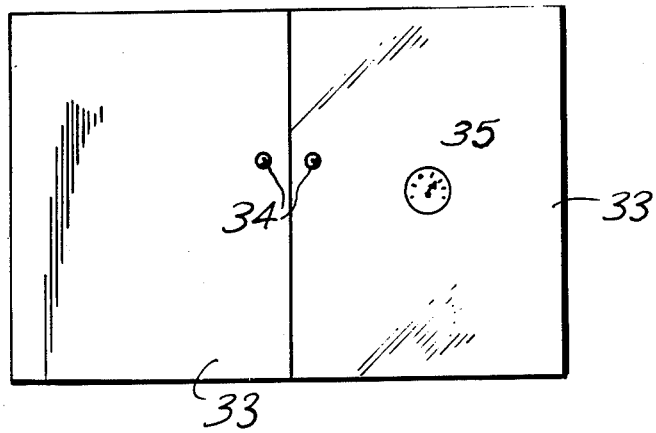
FIG. 2 is a front view of the doors of the device, shown in elevation.
Figure 2A:
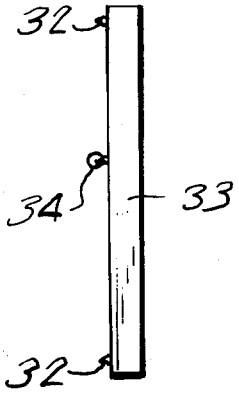
FIG. 2A is a side view of FIG. 2.
Figure 3:
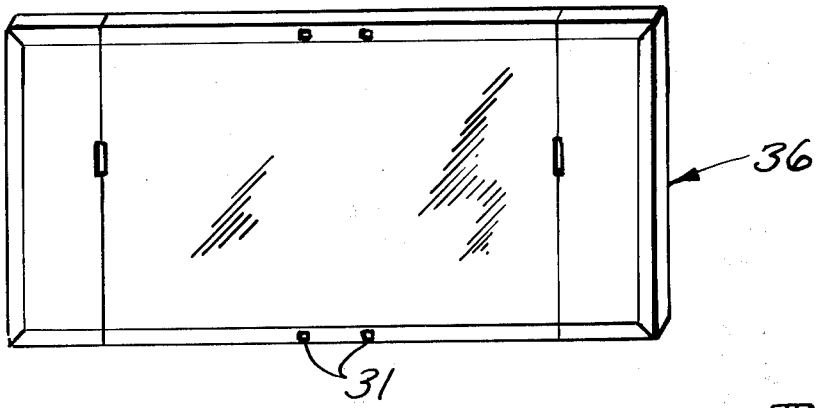
FIG. 3 is a perspective view of the door frame for a three burner unit.
Figure 4:
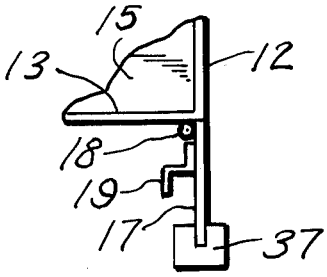
FIG. 4 is a fragmentary front view of the outside structure, shown in elevation, and seated in one of a pair of support rails.
Figure 5:
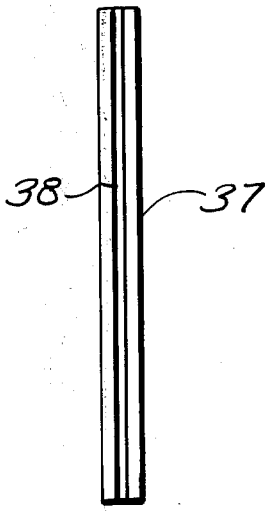
FIG. 5 is a top plan view of the rail shown in FIG. 4.

According to this invention, an attachable oven 10 is shown to include an outer casing 11, having parallel spaced apart side walls 12, a bottom wall 13, a top wall 14, and a rear wall 15. Rear wall 15 is provided with a corner cut-out 16, at each end. Cut-outs 16 are provided for the hinges of the cover of the camping stove, so as to enable the cover to lean against the back portion of oven 10.

A hinged plate 17 is secured, by hinge 18, to the lower portion of each of the side walls 12 of casing 11, and Z shaped members are fixedly secured, in a spaced apart relationship, to plate 17, so as to engage the camp stove. Secured pivotably to bottom wall 13, of the outer casing 11, are spaced apart locks 20, for engaging and retaining plate 17, when oven 10 is not in use upon the camp stove.

A cut-out 21, in each of the side walls 12, of outer casing 11, provide a means for turning the knob of another burner of the camp stove, when one is used for the electrical cord of a hot plate, if it is used. The inner casing 22, of oven 10, is shown to include parallel side walls 23, a U shaped bottom plate 24 and an upper frame 26. Secured to the interior of side walls 23, adjustably, are parallel spaced apart channel members 27 for supporting a grill or rack 28 (figure shown in phantom lines). A door frame 29, of hollow rectangular configuration, is provided with cut-out openings 30, for engaging the hinges of the doors, which hereinafter will be described. Spaced apart slots 31, through the longitudinal portions of frame 29, provide a means for receiving, snappably, the latch portions 32 of doors 33. Doors 33 are provided with knobs 34, and one of the doors 33 has secured therein a thermometer 35, which will indicate the temperature on the interior of oven 10.

Door frame 36 is of such structure, as shown, to accommodate a three burner unit.

A pair of wooden rails 37 provide levelling and support means for the hinged plates 17, which are received within the groove 38.

What I claim is:

1. An attachable oven for a camp stove, comprising in combination, an outer casing of hollow configuration, said outer casing having hinged plate means secured thereto, for adaptation to a camp stove, an inner casing received within said outer casing having adjustable means for supporting a grill, a door frame secured to said inner casing with door means hingeably secured thereto, grooved support rail means removably received on edges of said hinged plate means, and lock means secured to said outer casing for retaining said hinged plates.

2. The combination according to claim 1, wherein the rear wall of said outer casing is provided with lower cut-out openings, one in each corner, and the side walls of said casing are fixedly secured to said rear wall, the top wall, and the bottom wall of said outer casing and said retaining means for said hinged plates are pivotable and spaced apart locks which removably receive a longitudinal side edge of said hinged plates.

3. The combination according to claim 2, wherein said hinged plates are secured by said hinge means, which is fixedly secured to the lower edges of said side walls and said hinge plates have secured thereto, fixedly, in a parallel spaced apart manner, a pair of brackets which engage said camp stove and said inner casing includes a channel shaped bottom plate which is fixedly secured to a pair of parallel spaced apart channel shaped side walls, said side walls being fixedly secured to an upper frame of rectangular configuration, and secured fixedly to said side walls, on the interior of said inner casing, are a pair of spaced apart channels which support said grill, and frame means is secured to said inner casing and is hingably secured to a pair of doors.

* * * * *